US005299415A

United States Patent [19]

Wanger

[11] Patent Number: 5,299,415

[45] Date of Patent: Apr. 5, 1994

[54] HEAT TREATMENT AND/OR HUMIDIFICATION OF COPS

[75] Inventor: Freddy Wanger, Oberrohrdorf, Switzerland

[73] Assignee: Xorella AG, Wettingen, Switzerland

[21] Appl. No.: 741,470

[22] PCT Filed: Dec. 20, 1990

[86] PCT No.: PCT/CH90/00288

§ 371 Date: Aug. 2, 1991

§ 102(e) Date: Aug. 2, 1991

[87] PCT Pub. No.: WO91/10001

PCT Pub. Date: Jul. 11, 1991

[30] Foreign Application Priority Data

Dec. 22, 1989 [CH] Switzerland .....004632/89

[51] Int. Cl.[5] ..... D01H 9/02

[52] U.S. Cl. ..... 57/281; 57/308

[58] Field of Search ..... 57/308, 281; 68/5 C, 68/11

[56] References Cited

U.S. PATENT DOCUMENTS

| | | | |
|---|---|---|---|
| 488,787 | 12/1892 | Clay | 68/8 |
| 4,660,368 | 4/1987 | Küpper et al. | 57/276 X |
| 4,893,483 | 1/1990 | Kawasaki et al. | 57/281 X |
| 4,953,368 | 9/1990 | Kawasaki et al. | 57/281 X |
| 4,995,230 | 2/1991 | Tone et al. | 57/281 |
| 5,099,641 | 3/1992 | Igel et al. | 57/281 |
| 5,125,224 | 6/1992 | Klaus | 57/281 X |
| 5,157,910 | 10/1992 | Artzt et al. | 57/308 |

FOREIGN PATENT DOCUMENTS 2542291 9/1984 France .

*Primary Examiner*—Joseph J. Hail, III

*Attorney, Agent, or Firm*—Schweitzer, Cornman & Gross

[57] ABSTRACT

An apparatus for steaming of spun cops based on a trough-shaped steamer (2) arranged directly adjacent to a spinning machine (1) parallel to the cops (15) of a spinning station (14) standing in a row. This enables a conventional handling device (17) to move the cops (15) from the spinning stations (14) into the steamer (2) and, after the steaming process, to move the cops (15'') from the steamer (2) to the conveyor (16) of the spinning machine (1). The steaming process is thus integrated with the material flow of the spinning plant. The dwell times of the cops after steaming are largely predeterminable. Also, the space requirements of the equipment are minimal and there is no need for additional manual moving of the cops.

13 Claims, 15 Drawing Sheets

FIG. 10
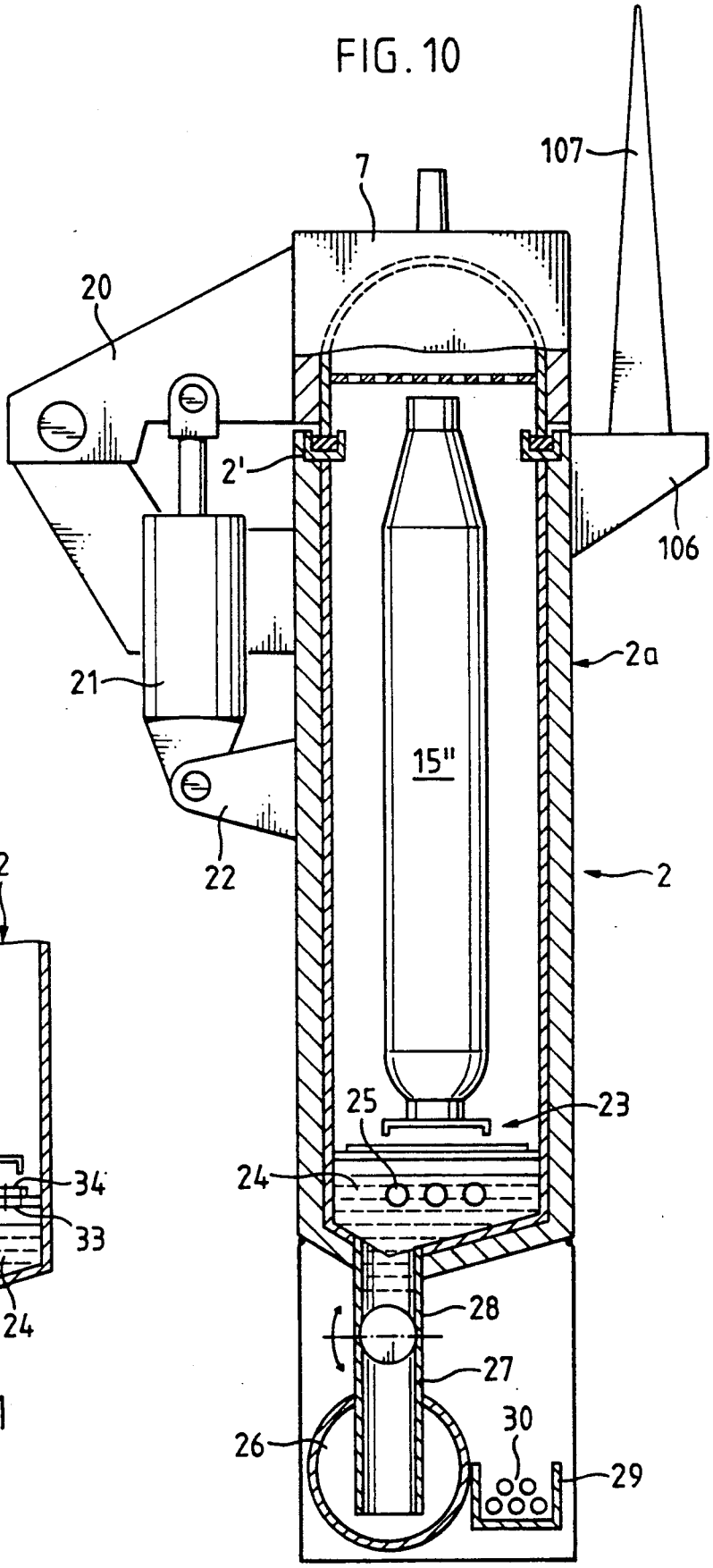
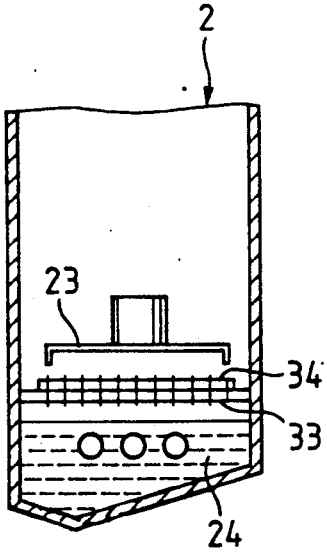
FIG. 11

HEAT TREATMENT AND/OR HUMIDIFICATION OF COPS

The invention relates to a method for shortening of the conveying paths during the heat treatment and/or humidification, in a steaming vessel, of cops spun onto bobbins at several spinning stations of a spinning machine. The invention further relates to a device for spinning, for heat treatment and/or humidification of yarns, comprising:

a spinning machine with several spinning stations arranged in a row, on which cops are produced, each of which contains a bobbin;

a conveyor for the removal of the fully-spun cops;

a handling device for delivering empty bobbins to the spinning machine and the removal of cops from the spinning machine, and the setting down of the cops onto the conveyor;

a steaming vessel for heat treatment and/or humidification of the fully-spun cops.

As used herein, the term "cop" generally refers to the spool onto which the fibers are placed after the spinning stage, as well as the mass of fibers themselves, while the term "bobbin" generally refers to the spool onto which the fibers are placed after the treatment process, as well as to the mass of fibers thereon. Those skilled in the art appreciate that the terms are generally interchangeable, often differing only in reference to size of the spool. Both typically have a core or "pirn" about which the fibers are wound. The use of a specific term herein is not intended to foreclose the use of the other in the invention.

With a known method and a known device of this type (FR-A-2620743 and RF-A-2614633), the steaming vessel is located between the spinning machine and the winding machine. By means of a conveyor belt, the fully-spun cops are moved from the spinning machine into the steaming vessel. Subsequently, the fully-steamed cops are moved from the steaming vessel to the winding machine by means of a second conveyor belt. A handling device is thus required to move the fully spun cops from the spinning machine onto the first conveyor belt. In addition, a second conveyor belt is required between the steaming vessel and the winding machine. With the known devices, there is thus need for two conveyor belts, which take up much space. With the known methods, there exists also the danger of material mix-up (of the cops).

Two of the objects of the invention are:

a) to provide a method for the heat treatment and the humification of cops, which can be carried out at an expenditure as low as possible and with changes in the equipment that require as little additional space as possible.

b) to provide a device which, in a manner as space-saving and simple as possible, facilitates heat treatment and/or humidification of cops.

According to the invention, the first of the above-mentioned objects is achieved in that each cop is subjected to heat treatment and/or humidification directly at the spinning station of the spinning machine, in order to avoid long transport paths between spinning machine and steaming vessel. (The term "spinning station", used in the claim, should be understood as referring to the space required—for yarn ballooning—around the cop to be produced.)

Thanks to this method, heat treatment and/or humidification of the cops is effected in direct proximity to the spinning stations of the spinning machines, obviating the need for a conveyor belt between spinning machine and steaming vessel. A particular advantage resides in the fact that dwelling time during and after steaming is largely freely selectable. Therefore, the cops need no longer be removed from the materialflow procedure. The method according to the invention can be carried out faster than the conventional method and precludes material mix-up. Furthermore, as compared to the known spinning plants with remotely placed steaming vessel, very much space is saved. The steaming vessel is designed as closable, open conduit in the form of an elongated trough.

The second of the above-mentioned objects, that is, the provision of a device for carrying out the method, is achieved in that, according to the invention, the steaming vessel comprises a number of steaming stations and is mounted parallel to the spinning machine in such a way that, at each spinning station, there is located a steaming station, and that, for each spinning station, the handling device is provided with a gripping member which removes the fully spun cops from the spinning station and introduces them into the adjacent steaming station of the steaming vessel.

Due to this design and arrangement of the steaming vessel, little space is required in the spinning plant for the steaming vessel. The course of work is furthermore optimized in that, for heat treatment and/or humidification, the cops must travel very short distances only.

The subsequent dependent claims characterize further developments of the object of the invention.

The method steps facilitate the use of a handling device which, with spinning machines, is required in any case and which, by slight modifications, can be adapted to remove the cops from the spinning stations and insert them into the steaming vessel, and to withdraw the steamed cops from the steaming vessel and place them onto the conveyor which moves the cops to the winding machines.

The invention may facilitate the use of and incorporate a handling device which can be adapted to remove the cops from the spinning stations and insert them into the steaming vessel, to withdraw the steam cops from the steam vessel and place them on to the conveyor which moves the cops to the winding machines. The operation of the several steps can be optimized for effective utilization of treatment and sequence times.

Temporary accommodation of one charge during the steaming treatment of another can be accomplished by a variety of manners, which can be selected according to the configuration of the spinning machine and/or its handling device and conveyor.

According to the particular design of the handling device and to the space conditions in front of the spinning machine, it may be advantageous either to arrange the steaming vessel on that sidde of a conveyor leading to the winding machine that faces away from the spinning machine, or to arrange it between the spinning machine and a conveyor leading to the winding machine and located in front of the spinning machine and/or the handling device.

Entrance of steam into the steaming vessel is easily interrupted by shutting off steam access openings by means of mutually slidable perforated sheet-metal strips.

Control of the water quantity is effected in a similarly simple way.

For transporting the cops, it is also possible to provide a horizontally and vertically travelling conveyor device arranged above the steaming vessel, instead of the conventional handling device or a modified handling device. Such a conveyor device could be designed, e.g., like a conventional portal charger in a doubling frame.

In the open state, the lid of the steaming vessel will not impede the moving of the cops, by the handling device, into the steaming vessel or from the steaming vessel to the conveyor, if the steaming vessel is provided with a lid hingedly articulated to a lateral wall of the steaming vessel which faces the spinning stations.

A particularly simple design is achieved if the lid is configured to be actuatable by means of a lifting cylinder articulated to the lateral wall and to a cantilever arm of the lid.

The steaming vessel can be adapted to spinning machines of differing sizes at low costs, if the steaming vessel is modularly assembled from several elements which, arranged one after the other, form the conduit-like steaming vessel.

In the simplest case, the heating element consists of an electrical resistance; it could equally be a heat exchanger of a steam heating installation, which is particularly advantageous in spinning mills with already existing heat recovery plants.

For clearer understanding, an example of the method according to the invention and various embodiments of the device according to the invention for carrying out the method are described in detail in the following and with reference to the attached drawings in which, partly schematically:

FIG. 10 represents a vertical cross-section through a steaming vessel according to a first embodiment;

FIG. 11 is a vertical cross-section through the lower portion of the steaming vessel according to a second embodiment;

Figure 18:
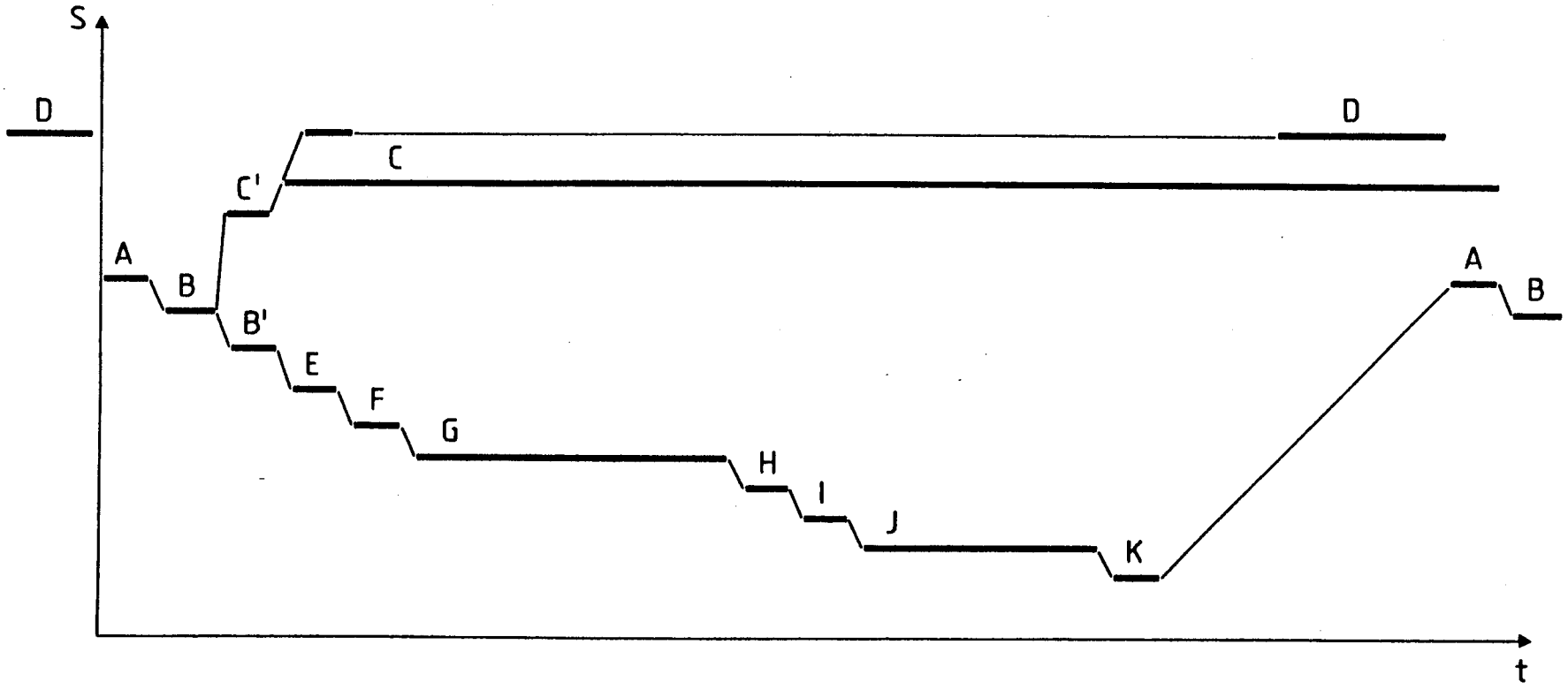
Figure 19:
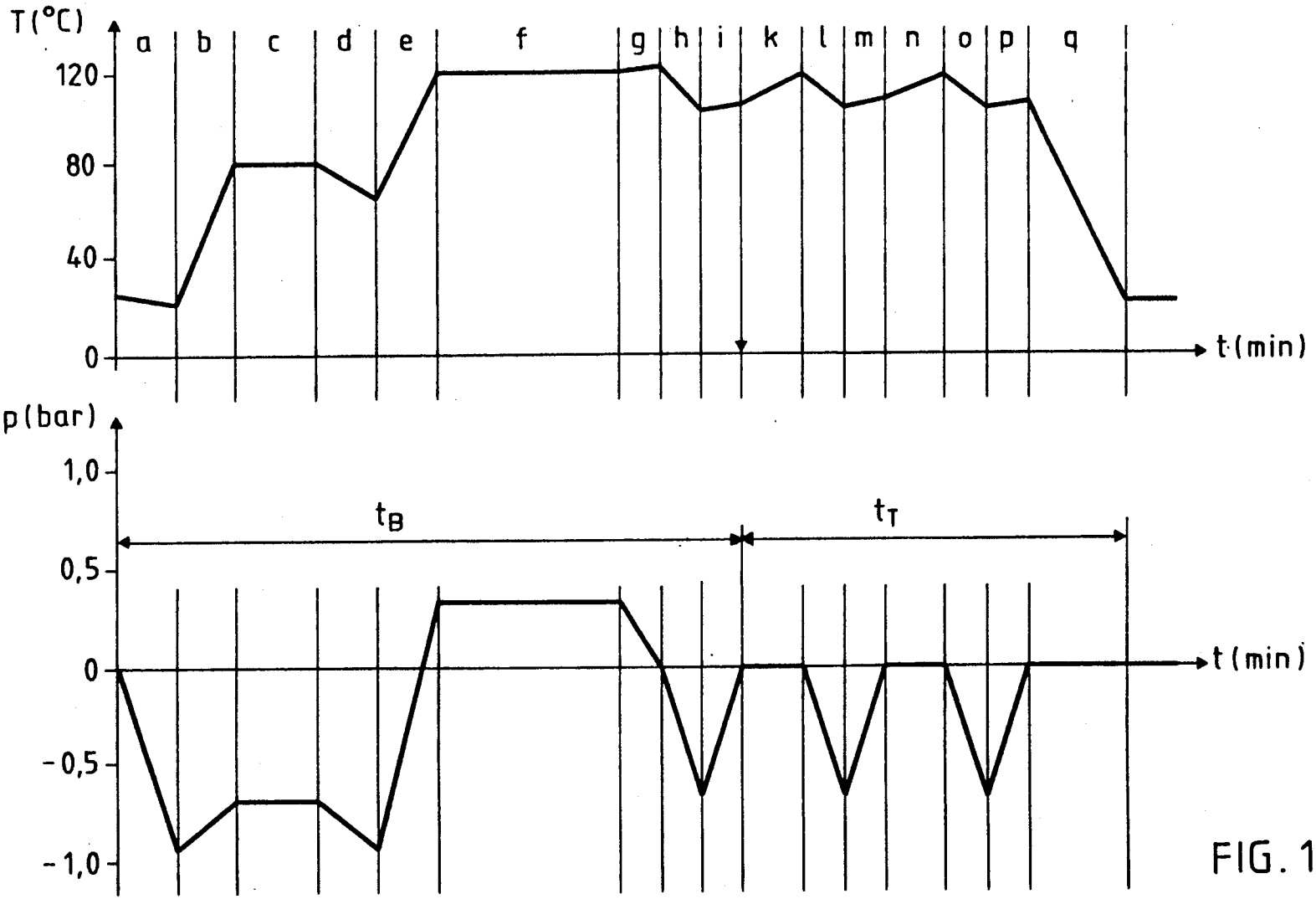
Figure 20:
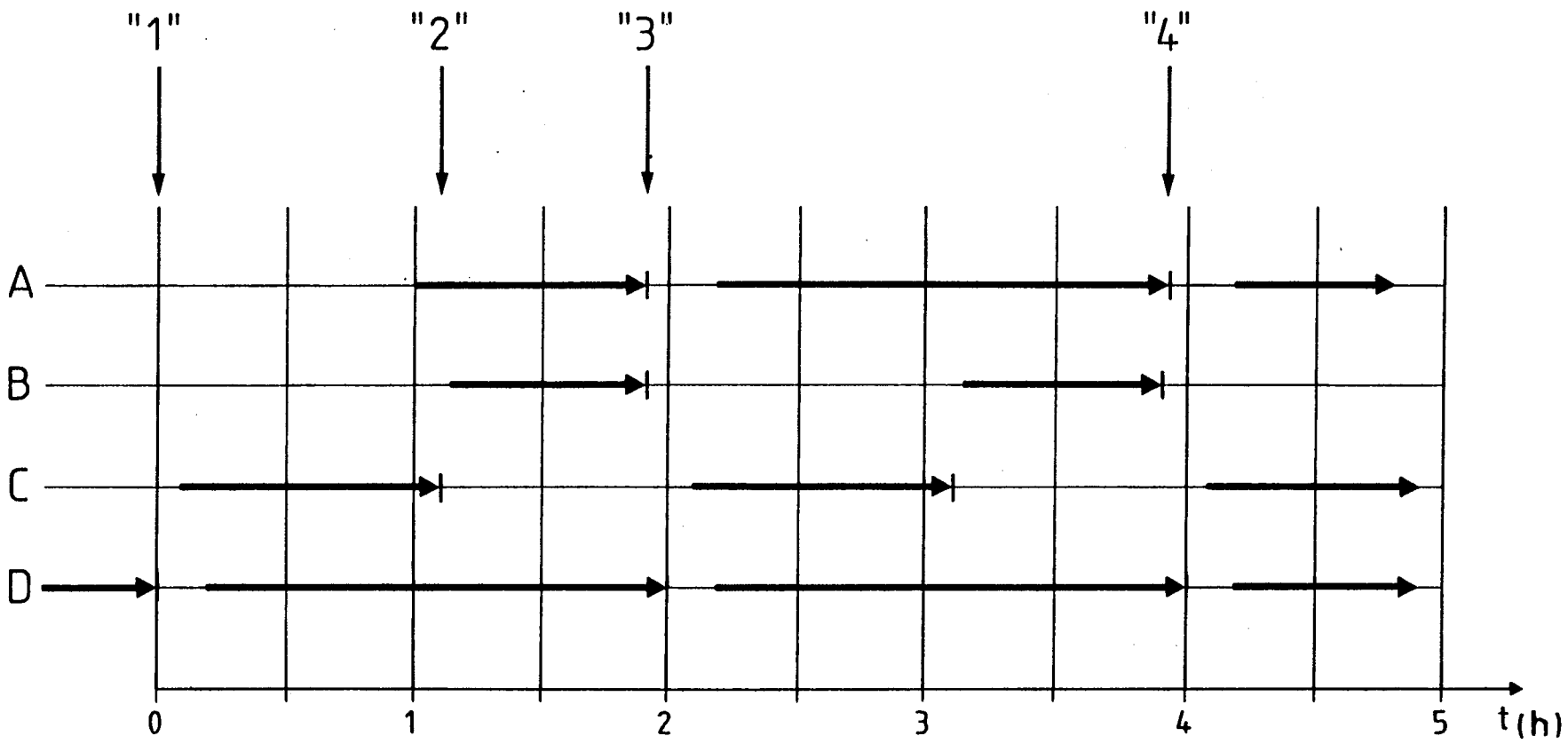
Figure 21:
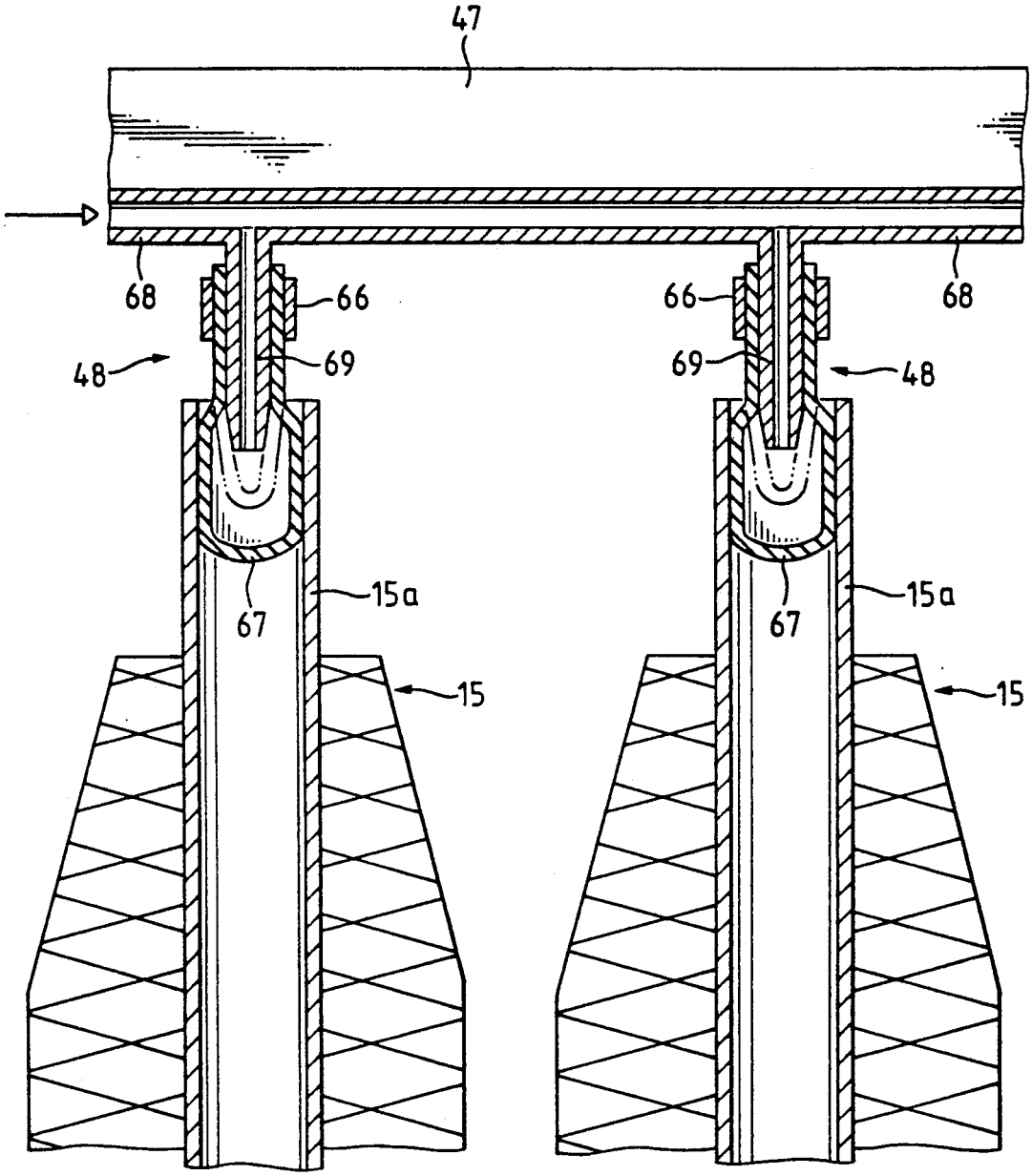

FIG. 18 schematically indicates the course of the separate method steps as a function of the time t;

FIG. 19 shows a diagram illustrating the course of temperature and pressure in the steaming vessel as a function of time t;

FIG. 20 indicates the temporal course of the method according to the invention as well as the course of material flow, and FIG. 21 is a schematic drawing relating to a commercially available cop-removal rail.

Figure 1:
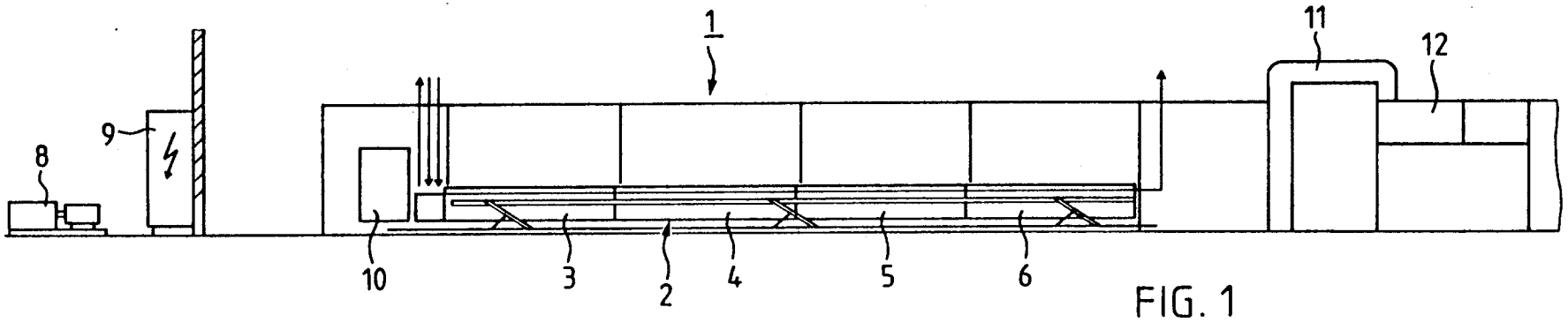
FIG. 1 is an elevational view of the device for spinning and for heat treatment of yarns wound to form cops.
Figure 2:
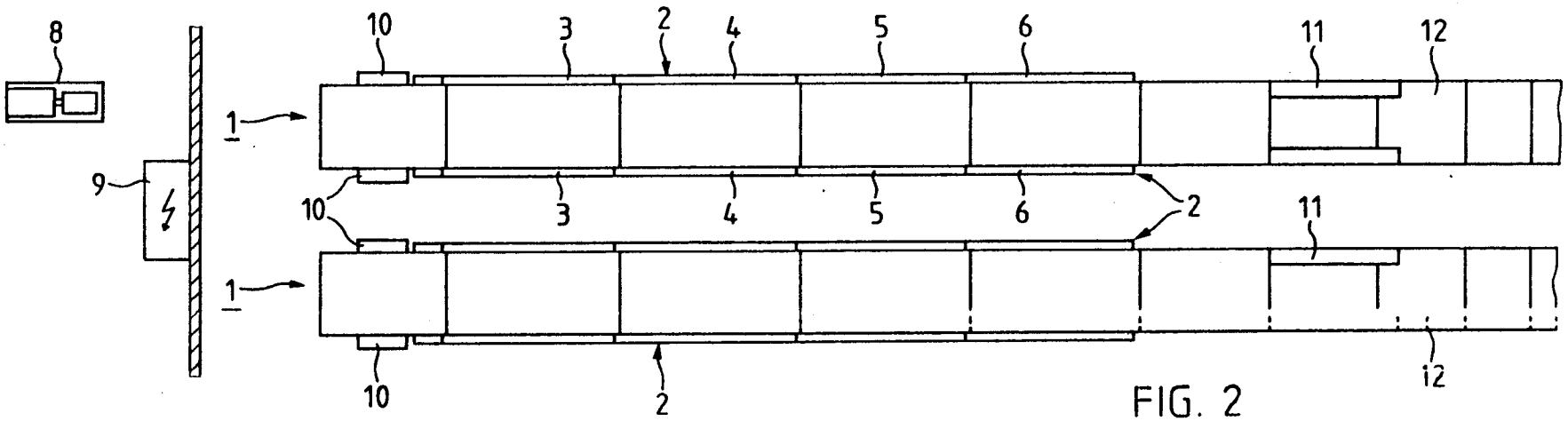
FIG. 2 is a top view of the device shown in FIG. 1.
Figure 3:
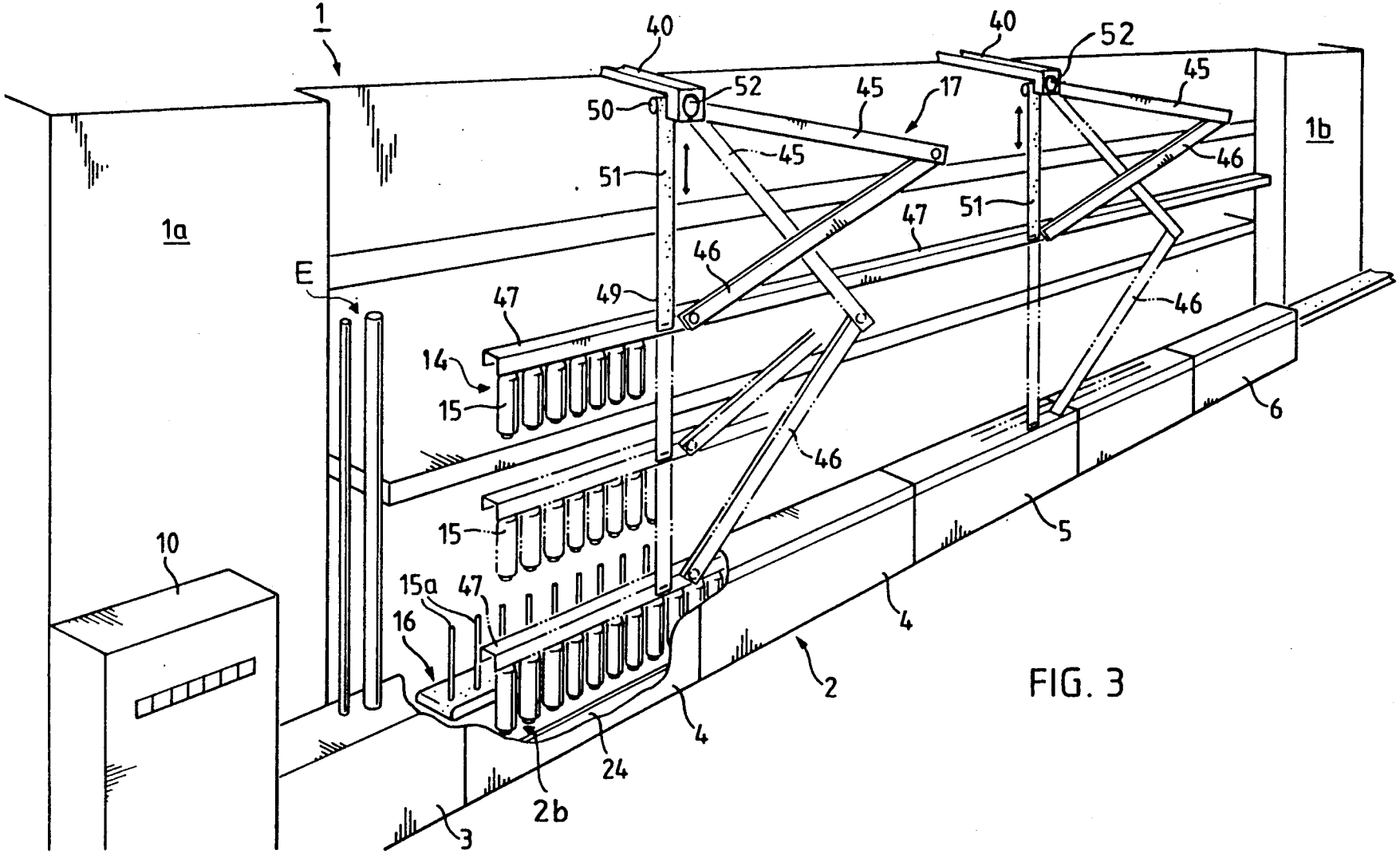
FIG. 3 represents a perspective view of the device shown in FIGS. 1 and 2.

According to FIGS. 1 to 3, the device for spinning, for heat treatment and/or humidification of yarns comprises the following elements:

a) A spinning machine 1 for producing cops.

b) A steamer 2 for heat treatment and/or humidification of the cops 15 produced by the spinning machine. As can be seen in FIG. 2, one steamer 2 is arranged on each side of the spinning machine 1. According to FIGS. 1 and 3, this steamer 2 comprises a head element 3, intermediate elements 4 and 5, and a terminal element 6, the number of intermediate elements depending on the length of the spinning machine 1 and, according to this length, being larger or smaller.

c) A vacuum unit 8 which, if necessary, can be used to produce a vacuum in the steamer.

d) An electric control panel 9.

e) A conveyor 16 for delivery and removal of empty bobbins 15*a* and of finished cops 15 (FIG. 3).

f) A handling device 17 which has the following tasks:

1) The empty bobbins 15*a* supplied by the conveyor 16 are mounted on the spinning machine 1.
2) The cops 15 finish-wound on the spinning machine 1 are introduced into the steamer 2.
3) The finish-steamed and/or humidified cops are withdrawn from the steamer 2, and
4) The cops withdrawn from the steamer are mounted on the conveyor 16 by the handling device 17.

In the following, these elements will be described in greater detail:

a) The spinning machine 1 is provided on both ends with drive gearboxes 1*a* and 1*b* respectively (see FIG. 3). Between these two drive gearboxes 1*a* and 1*b*, as can be seen in FIG. 3, there is located a row of cops spun on the spinning machine 1 in a per se known manner not further detailed here. As the spinning machine 1 is also assumed known, no further details thereof will be described here.

b) The steamer 2 comprises in its head element the following elements:

a vacuum and aeration line
a temperature sensor
a pressure sensor
a feed-water connector, and
a drive for opening and closing of the steaming vessel.

In its intermediate elements 4 and 5, the steamer furthermore comprises:

heating elements, electrical or steam, and
a water-level sensor.

The terminal element 6 of the steamer comprises the following elements:

a ventilator
further heating elements, and an additional drive for opening and closing of the steamer.

As the steamer 2 differs only slightly from known steamers of this type, not all of the above-mentioned components are described in detail.

According to FIG. 1, there are located on one end of the spinning machine 1 the vacuum unit 8 and the electric control panel 9, both of which are also assumed as known and are not described. According to the size of the steamer 2, the vacuum unit 8 is provided with one or several vacuum pumps which, too, are not illustrated in detail or described. On the electric control panel 9 are disposed electric current distributors, especially protective gear for the motors and for the heating elements equally regarded as known and thus not described in detail. The electric control unit 10 accommodates all elements for control and monitoring of the following data:

a) water and steaming space temperature
b) water and steam pressure
c) water level
d) water-bath cover
e) aeration of steaming vessel.

Figure 5:
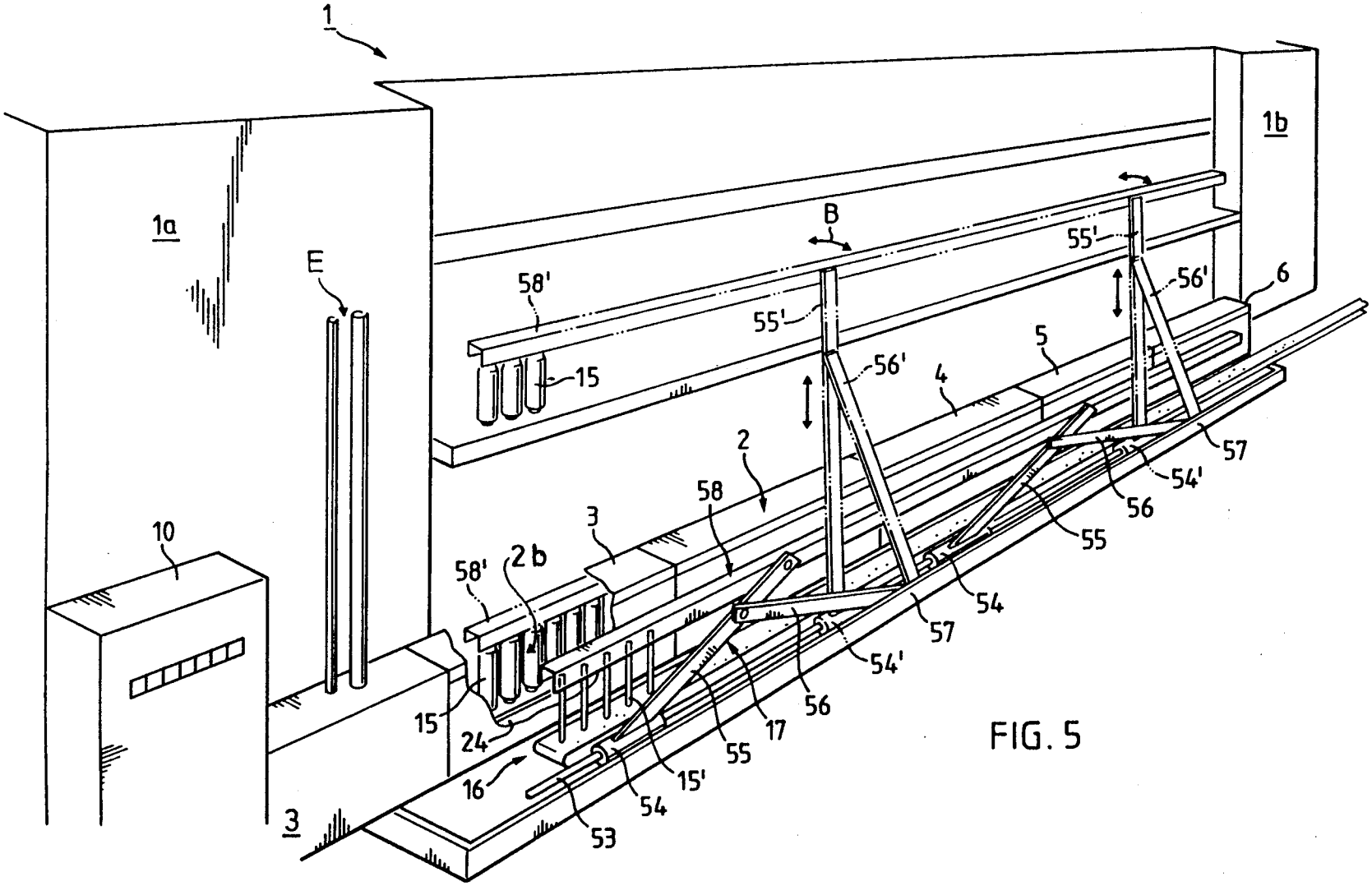
FIG. 5 is a perspective view of a second embodiment of the device for spinning and for heat treatment of yarns wound to form cops.

As seen in FIGS. 3 and 5, the steamer 2 extends over the entire length of the spinning machine 1 and has as many steaming stations as the spinning machine has spinning stations 14.

All these control and monitoring elements are regarded as known and are therefore neither illustrated nor described.

As seen in FIG. 2, two spinning machines 1 are mounted next to each other. One steamer 2 is located on each side of these spinning machines 1. Each steamer is equipped with an electric control unit 10.

Figure 4:
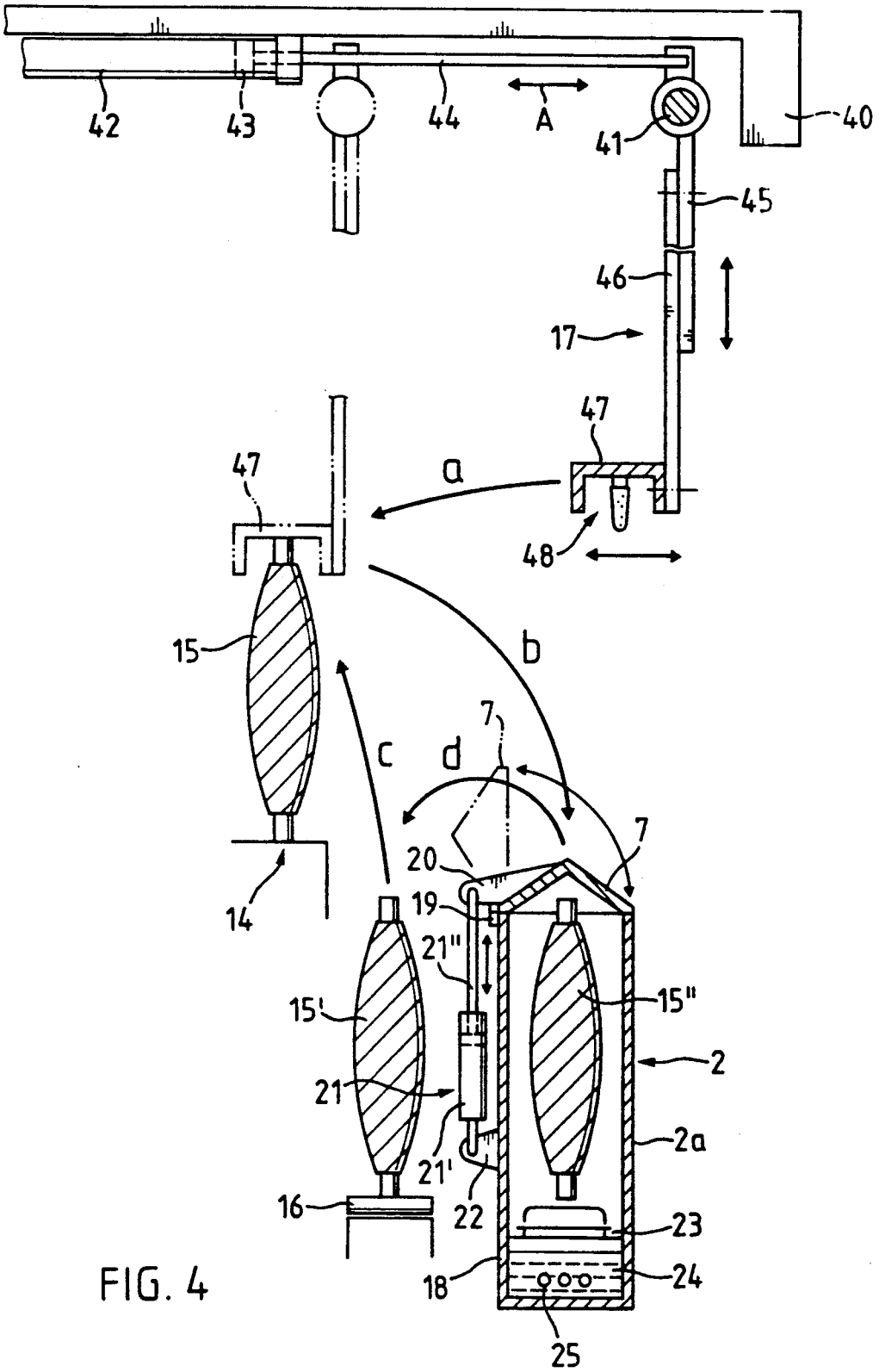
FIG. 4 is a side view of the device shown in FIGS. 1 to 3.

As seen in FIGS. 3 and 4, a cop 15 is located at each spinning station 14. According to FIG. 3, the spinning machine 1 is provided with a long row of spinning stations 14 extending between the two drive gearboxes 1*a* and 1*b*, which stations are all provided with cops. Behind this row of spinning stations 14 and located somewhat lower than these stations there is seen a conveyor 16.

Essentially, this conveyor 16 has two tasks:

1) The empty bobbins 15*a* are to be delivered to the spinning stations 14;
2) The ready cops are to be delivered to a winding machine 12 (FIG. 1).

To this end, the conveyor 16 extends over the entire length of the spinning machine 1 and has as many receiving stations as the spinning machine 1 has spinning stations 14. In front of this conveyor 16 is located the steamer 2 which similarly extends over the entire length of the spinning machine 1 and has as many receiving stations as the spinning machine 1 has spinning stations 14.

As can be seen in FIGS. 3 and 4, the handling device 17 is articulated to two beams 40 disposed on top of the spinning machine 1. As indicated in FIG. 4, a shaft 41 is slidably mounted on this beam 40. By means of an actuating cylinder 42, it is possible to shift the shaft 41 from its outermost position, indicated by solid lines, to a rearward position denoted by dash-dotted lines. In the cylinder 42 attached to the beam 40, there is disposed a piston 43 attached via a piston rod 44 to the shaft 41.

Shifting the piston 43 is effected in the usual manner pneumatically or hydraulically. To the shaft 41 (FIG. 4) are pivotably articulated two bars 45, as seen in FIG. 3. To the lower ends of these bars 45 there are articulated two further bars 46 and to the lower ends of the bars 46 is attached a cop-removal rail 47. This rail 47 extends over the entire length of the spinning machine 1 and has a gripping member 48 for each spinning station 14 of the spinning machine 1, for the handling of a cop. This gripping member 48 is illustrated in FIG. 4 and described in detail further below. For raising and lowering of the cop-removal rail 47, there is mounted on each beam 40 a drum 50, on which is wound a band 51, the lower end 49 of which is attached to the cop-removal rail 47. As shown in FIG. 3, with the aid of the bands 51 it is possible to lower the rail 47 from the uppermost position indicated by solid lines to lower positions indicated by dash-dotted lines, with the bars 45 and 46 at the same time swivelling into the dash-dotted positions. A motor 52 can be used to rotate the drum 50 in both rotational directions for winding up and unwinding the band 51. As seen in FIG. 4, the removal rail 47 with the gripping members 48 needs to be brought into three different positions, namely:

a) above the spinning stations 14
b) above the conveyor 16
c) above the steamer 2.

It must therefore be possible to shift the piston 43 to three different positions and to correspondingly lower the band 51 to three different heights. As seen in FIG. 4, the steamer 2 with a steaming vessel 2*a* that is of a rectangular cross-section, is located at a level lower than that of the conveyor. A lid 7 is articulated by means of a hinge 19 to that lateral wall 18 of the steamer which faces the spinning machine 1 or the conveyor 16. The lid 7 is provided with a cantilevered arm 20 on which acts a lifting cylinder 21 articulated at its lower end to a projection 22 of the lateral wall 18. A piston 21′ in the lifting cylinder 21 is articulated to the cantilevered arm 20 via a piston rod 21″.

If the piston 21′ and the piston rod 21″ move downwards, the lid 7 is opened.

As seen in FIGS. 3 and 4, a row of cops is disposed inside the steaming vessel 2 above a water bath 24. This water bath is provided with a water-bath cover 23 on which the cops 15 are retained at the steaming stations. The water bath can be cyclically heated by heating elements 25.

With the spinning plant according to the invention, material handling is as follows: As soon as a row of cops 15 is fully spun, the automatic handling device 17 moves to the left (as seen in FIG. 4), takes hold of all cops 15 of the spinning stations at once, and transports them into the opened steaming vessel 2*a*. In FIG. 4, this course is indicated by the two arrows a and b. As soon as the cops 15″ are inside the steaming vessel 2*a*, its lid 7 is closed by means of the lifting cylinder 21 and the steaming process can commence. During the steaming process, the handling device 17 fetches empty bobbins (not shown in FIG. 4), and deposits them onto the spinning stations 14. This is indicated by arrow c. Subsequently, the next charge of cops 15 can be spun. Upon conclusion of the steaming process in the steaming vessel 2*a*, the handling device 17, after opening of the lid 7, withdraws the cops 15″ from the steaming vessel 2*a* and deposits them onto the conveyor 16. This movement is indicated by arrow d. The conveyor 16 then transports the cops 15′ to the winding machine 12 (FIG. 1). This cycle repeats itself by the handling device 17 again introducing ready-spun cops 15 into the steaming vessel 2*a*.

Figure 6:
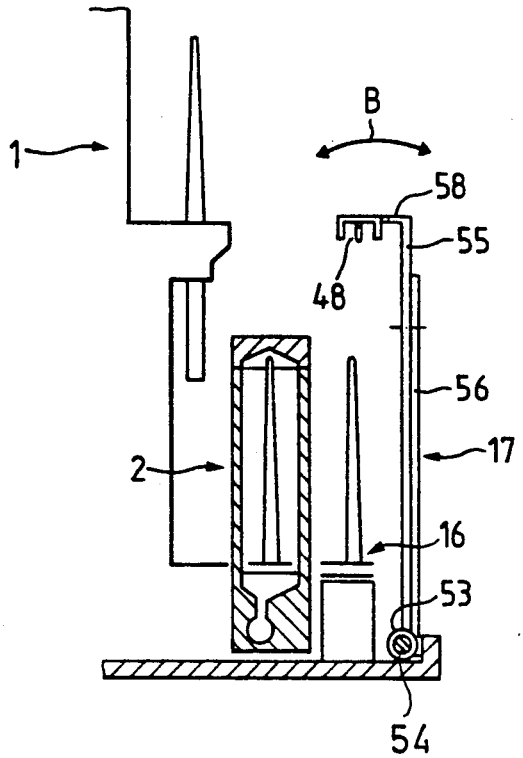
FIG. 6 is a side view of the device shown in FIG. 5.

With the equipment according to FIGS. 5 and 6, the steamer 2 is located between the spinning machine 1 and the conveyor 16. The handling device 17 is arranged on that side of the conveyor 16 which faces away from the spinning machine 1.

As seen in FIGS. 5 and 6, a spindle 53 is located in front of the conveyor 16 at the lowermost level of the spinning machine 1 and extending along the entire length thereof. Two slides 54 are slidably mounted on this spindle 53. To each of these slides there is tiltably articulated a bar 55. A second bar 56 is on one side stationarily articulated at a point 57 (FIG. 5) and, on the other side, articulated to the bar 55, at a point close to the upper end thereof. To the upper end of both bars 55 is articulated a cop-removal rail 58. This cop-removal rail 58 extends over the entire length of the spinning machine 1 and has a gripping member 48 for each spinning station of the spinning machine 1, exactly as was the case with the above-mentioned removal rail 47. This gripping member 48 is shown in FIG. 4 and described in detail further below. For raising and lowering of the cop-removal rail 58, the spindle 53 is rotated, which causes the slide 54 to be shifted to the position 54' and the two bars 55 and 56 to be moved to the dash-dotted position of the bars 55' and 56'. Due to the swiveling of the bars 55 and 56 into the position 55' and 56', the cop-removal rail 58 is moved from its lower position to its higher position, denoted by the numeral 58'. Furthermore, as seen in FIG. 6, the two bars 55 and 56 can also be swiveled about the axis of the spindle 53, as indicated by arrow B, enabling the cop-removal rail 58 not only to be raised and lowered, but also to be swung left or rightwardly.

Figure 7:
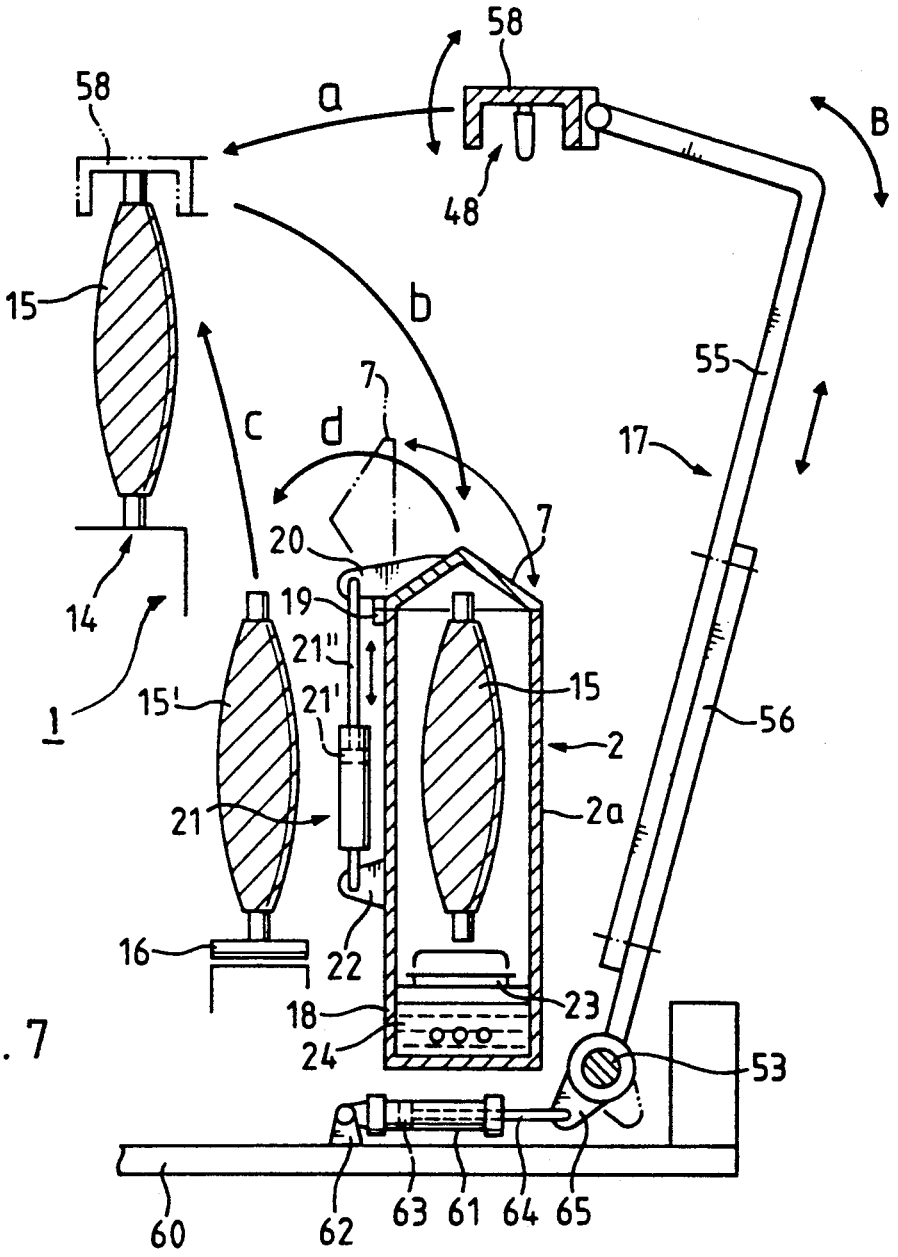
FIG. 7 shows a side view of a third embodiment of this device.

For swiveling of the slide 54 about the axis of the spindle 53, a cylinder 61 is hingedly articulated to a bracket 62 slidable on the floor 60 in a direction parallel to the spindle 53, as shown in FIG. 7. In this cylinder 61 there is disposed a piston 63 which, via a piston rod 64, is connected to a swivel arm 65 fixedly attached to the slide 54. By shifting the piston 63 in the cylinder 61, the slide 54 can thus be rotated and the bars 55 and 56 swiveled, as indicated by arrow B in FIGS. 6 and 7. As was the case in the first embodiment (according to FIGS. 3 and 4), the cop-removal rail 58 of the second embodiment (FIGS. 5, 6 and 7), too, must be moved to three different positions. These movements are as follows:

a) For gripping the cops 15, the handling device is swung to the left, arrow a.
b) From the spinning stations 14, the cops are moved into the steaming vessel 2a, arrow b.
c) The steamed cops 15 are moved from the steaming vessel 2a to the conveyor 16, arrow d.
d) Empty bobbins are brought by the conveyor 16 to the spinning stations 14 of the spinning machine 1, arrow c.

In FIGS. 6 and 7, the same handling device 17 is used. In FIG. 7, however, the steamer 2 is located between conveyor 16 and spinning machine 1, while in FIG. 7 the conveyor 16 is located between steamer 2 and spinning machine 1.

Figure 8:
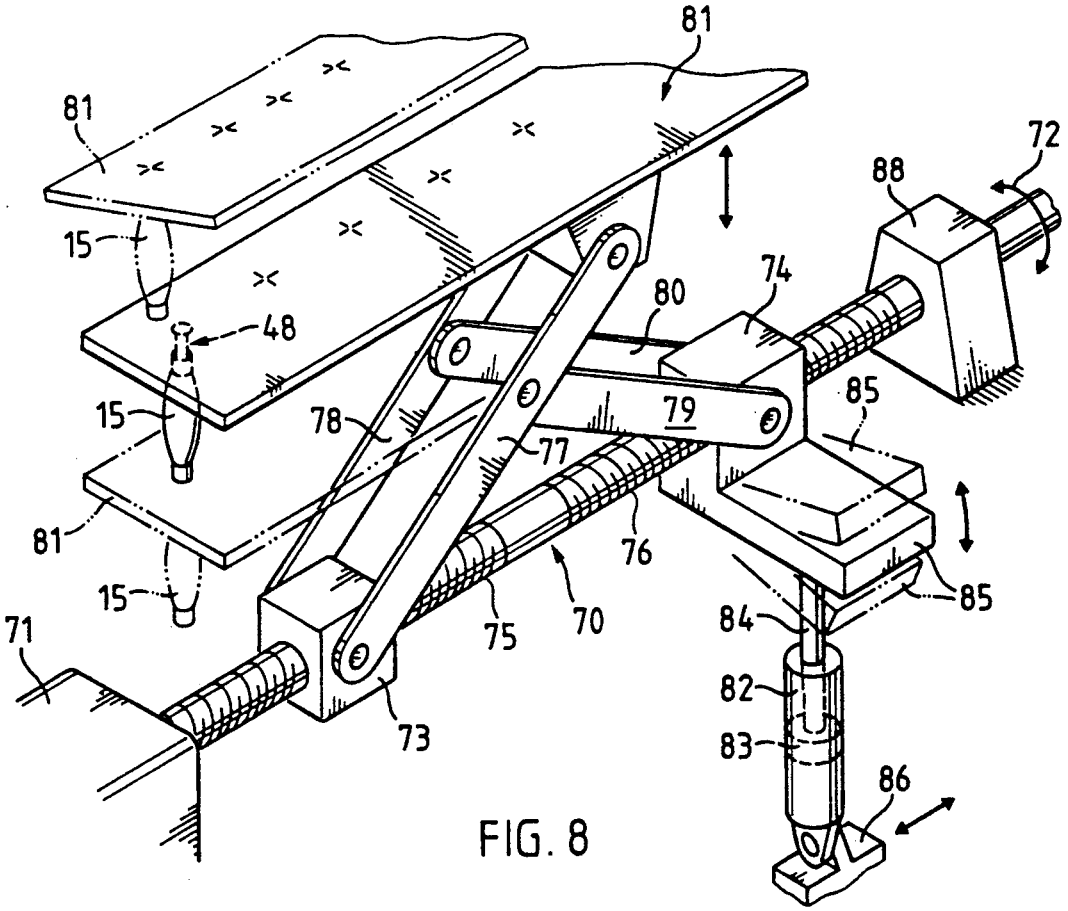
FIG. 8 is a perspective drawing of another embodiment of the mechanism for controlling the cop-removal rail.

According to FIG. 8, a spindle 70 can be driven by a motor 71 in both senses of rotation, as indicated by a double arrow 72. On this spindle 70 there are movably guided two slides 73 and 74. One slide, 73, is moved by a right-handed thread 75, the other by a left-handed thread 76, in such a way that upon rotation of the spindle 70 by the motor 71, the two slides 73 and 74 are moved towards each other when the spindle 70 is rotated in one sense of rotation, and away from each other when the spindle is moved in the other sense of rotation. To both slides there is articulated a scissor-like lever system 77, 78, 79, 80. To the levers 77 and 78 of this lever system 77 to 80 there is articulated an already mentioned cop-removal rail 81 which, exactly as the earlier mentioned cop-removal rails 47 or 58, extends along the entire length of the spinning machine 1. This cop-removal rail 81 is raised and lowered by several lever systems 77 to 80. FIG. 8, however, shows only a single lever system 77 to 80. The spindle 70, too, extends along the entire length of the spinning machine 1 and serves for driving all lever systems 77 to 80. For swinging over the lever system 77 to 80, including the cop-removal rail 81, there is provided a cylinder 82 comprising a piston 83. Via a piston rod 84, this piston 83 is articulated to a plate 85 attached to the slide 74. With the aid of the cylinder 82, it is thus possible to swing the plate 85 together with the slide 74 and the lever system 77 to 80 into three different positions, indicated by dash-dotted lines representing the plate 85 and the cop-removal rail 81. To this cop-removal rail 81 are attached gripping members 48 described further below (see FIG. 21) for the gripping of the cops 15. The cylinder 82 is articulated to a support 86 slidable in a direction parallel to the spindle 70. The spindle 70 is supported by several mounts 88, of which in FIG. 8 only one is shown. The arrangement of FIG. 9 differs from that shown in FIG. 8 mainly in that the two slides 73 and 74 with the lever system 77 to 80 are not tiltable. Instead, the lever system 77 to 80 raises or lowers a plate 87 when the spindle 70 is rotated in one or the other sense of rotation. To this plate 87 is also articulated a scissor-like lever system 89 and 90 and to the lever 89 is articulated the already-mentioned cop-removal rail 81. For shifting of the copremoval rail 81 in the horizontal direction according to arrow 91 serves a cylinder 92 which comprises a piston 93 that is articulated via a piston rod 94 to the lever 89 of the lever system 89 and 90. The cylinder 92 itself is articulated to the cop-removal rail 81. With the aid of the spindle 70, the plate 87 can thus be raised and lowered in direction of arrow 92', and with the aid of the cylinder 92, the cop-removal rail 81 can be shifted in the horizontal direction. To enable the scissor-like lever system 89, 90 to be opened and closed, one end of the lever 90 of the lever system 89, 90 is movably mounted in a slot 87' in the plate 87.

As seen in FIG. 10, the steaming vessel 2a is located above a water duct 26 having a circular cross-section. A riser 27 leads from the water duct 26 upwards into the water-bath space 24 of the steaming vessel 2a. A shut-off valve 28 enables opening and closing of the riser 27. The water-bath cover 23 serves for supporting the cops 15" introduced into the steaming vessel 2a. Further seen in FIG. 10 is a cable duct 29, extending in parallel to the water duct 26 and accommodating electrical lines. Seen as well, in the region of the lid 7, are sealing elements 2'.

Figure 9:
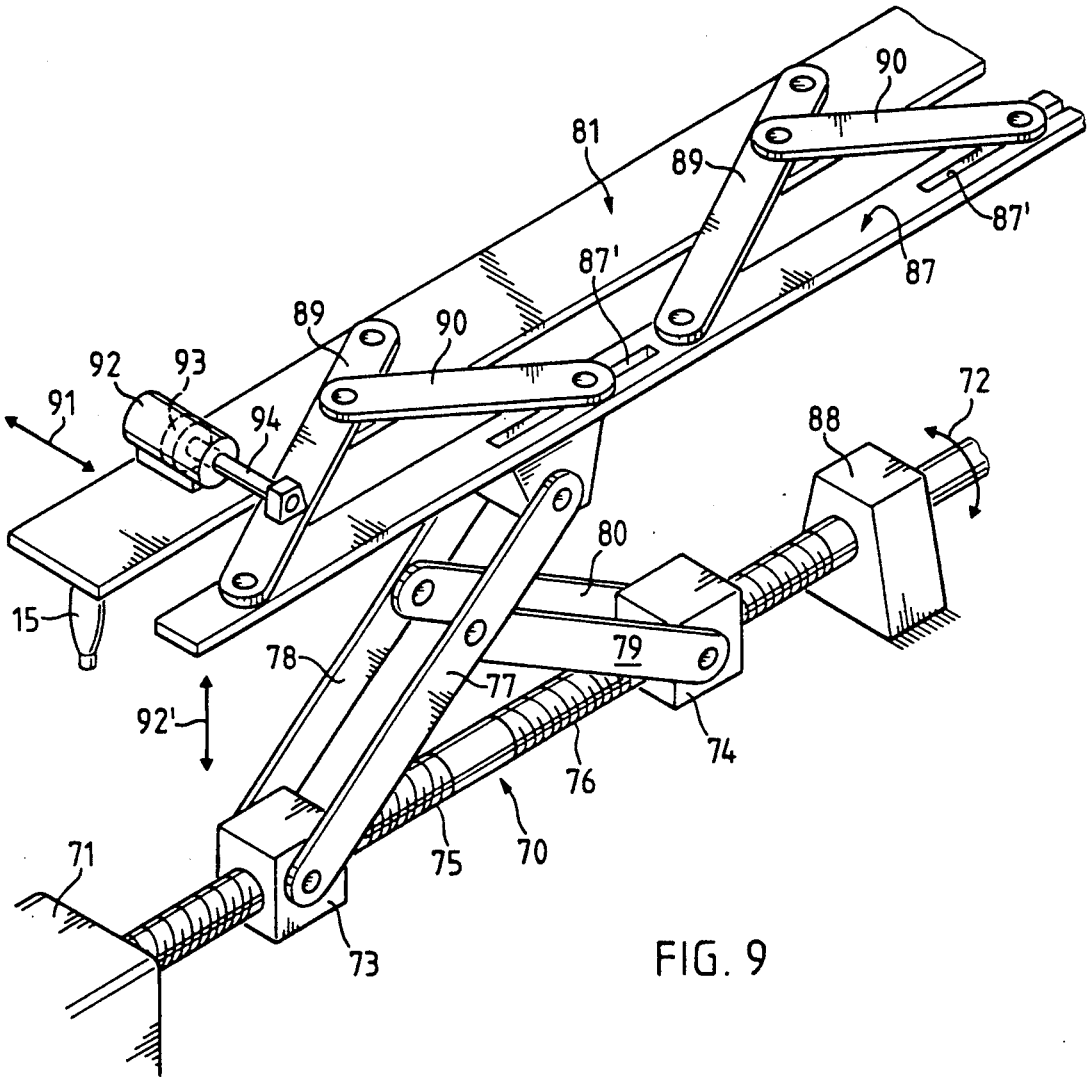
FIG. 9 is a perspective view of this device according to a fourth embodiment.

Also seen in FIG. 10 is an arm 106, attached to the steaming vessel 2a, on which arm 106 there is located a conical mandrel 107 which serves for centering of the cop-removal rail 47, FIG. 3; or 58, FIG. 5; or 81, FIGS. 8 and 9.

In the embodiment according to FIG. 11, the water-bath space 24 is covered by two superposed perforated sheet-metal strips 33, 34. While the lower perforated strip 33 is fixedly attached to the walls of the steaming vessel 2a, the upper strip 34 can be slid upon the lower perforated strip 33 in the longitudinal direction thereof.

This enables the water-bath space 24 to be shut off from the rest of the internal space of the steaming vessel 2*a*. Here, too, the water-bath cover 23 serves as support for the cops.

Figure 12:
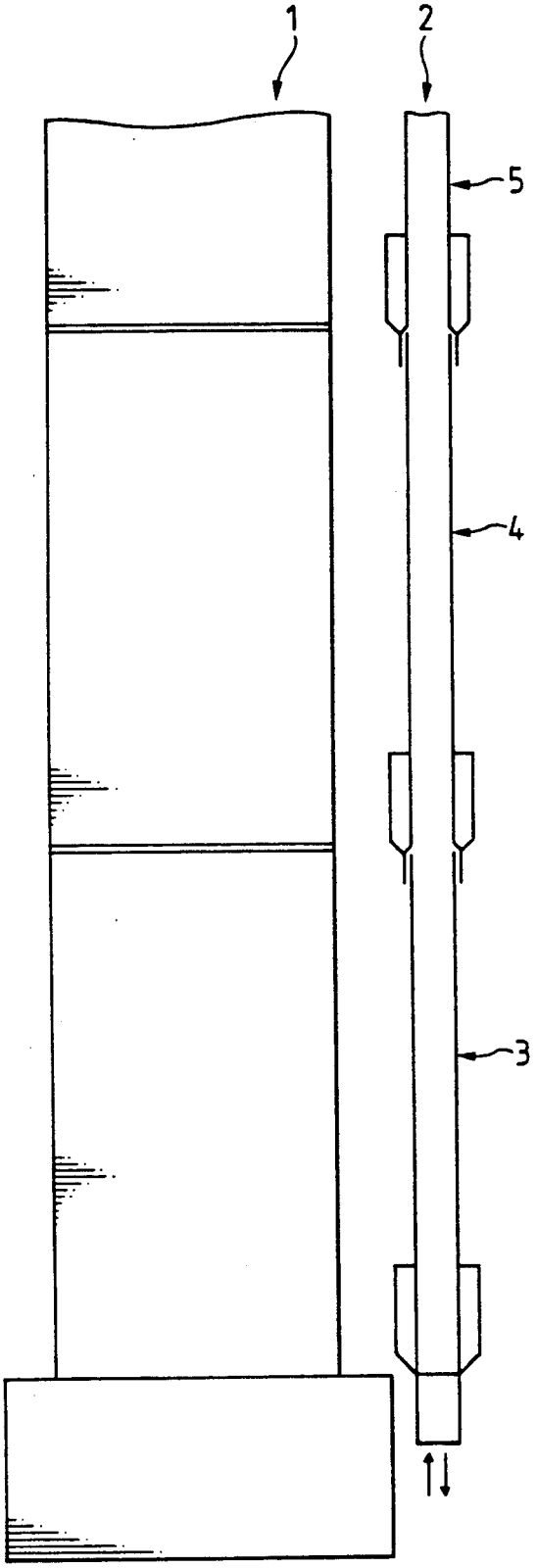
FIG. 12 is a top view of the spinning machine and the steaming vessel, in a modular design.

As seen in FIG. 12, the steamer 2 extends over the entire length of the spinning machine 1 and is composed of several intermediate elements 3, 4 and 5. As this steamer is exposed to large temperature fluctuations, means must be provided to permit the intermediate elements 3, 4 and 5 to freely expand and contract. Two embodiments of such means are represented in FIGS. 13 and 14.

Figure 13:
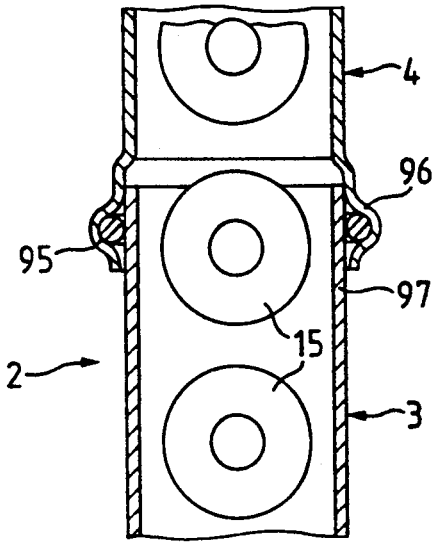
FIG. 13 illustrates a detail, at an enlarged scale, of FIG. 12, according to a first embodiment.

As shown in FIG. 13, an O-ring as sealing ring 95 is provided at the end of one intermediate element 3, which O-ring makes contact with the inside wall 96 of the other intermediate element 4. When the two intermediate elements 3 and 5 expand or contract, the sealing ring 95 can slide along the outside wall 97 of the intermediate element 3. The inside wall 96 surrounds the sealing ring 95 like an annular groove.

Figure 14:
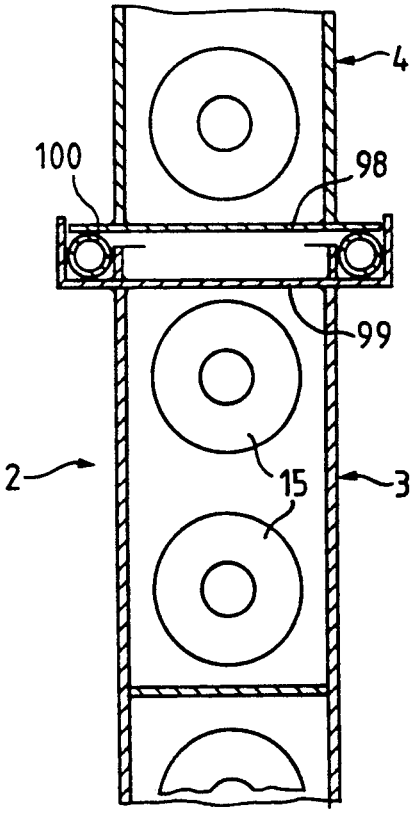
FIG. 14 shows a detail, at an enlarged scale, of FIG. 12, according to a second embodiment.

According to FIG. 14, a hose-like, dilatable seal 100 is provided between a front wall 98 of the one intermediate element 4 and a front wall 99 of the other intermediate element 3, which seal 100 is compressible when the two intermediate elements 3 and 4 of the steamer 2 thermally expand.

Figure 15:
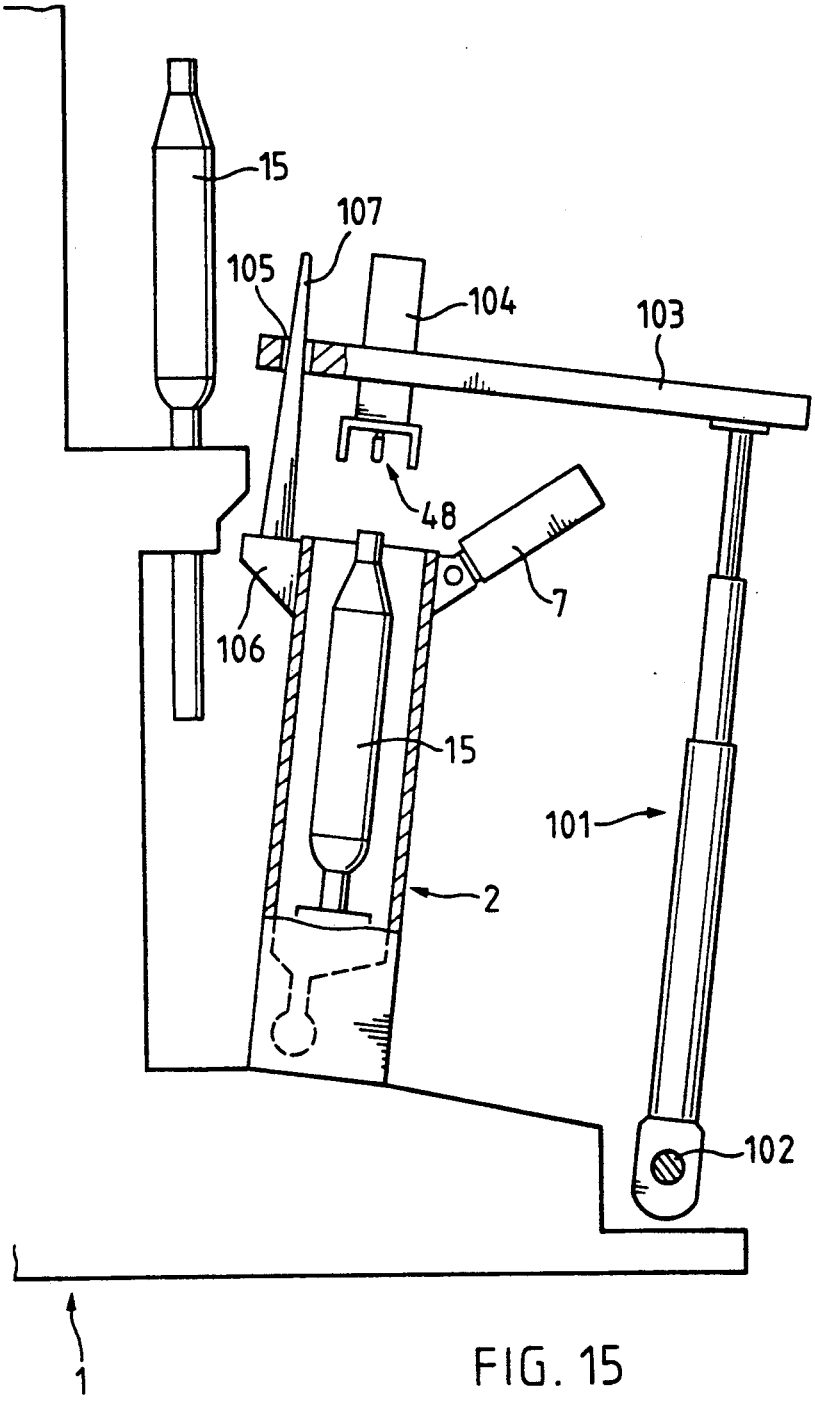
FIG. 15 is a cross-section through a further embodiment of the device represented in FIGS. 1 and 2.

As shown in FIG. 15, there is provided a telescoping bar 101 pivotable about a shaft 102. This telescoping bar 101 consists of three tubular sections having different diameters, so that they can telescope into each other. Via a carrier arm 103, a cop-removal rail 104 is attached to this bar 101. To this copremoval rail 104 are attached the gripping members 48 described further below in conjunction with FIG. 21, which members are used to move the cops 15 from the spinning machine 1 to the steamer 2. Via an arm 106, the conical mandrel 107 is attached to the steamer 2, which mandrel 107 projects into a bore 105 of the carrier arm 103. This makes sure that the cops 15 are introduced into the steamer 2 with precision.

Figure 16:
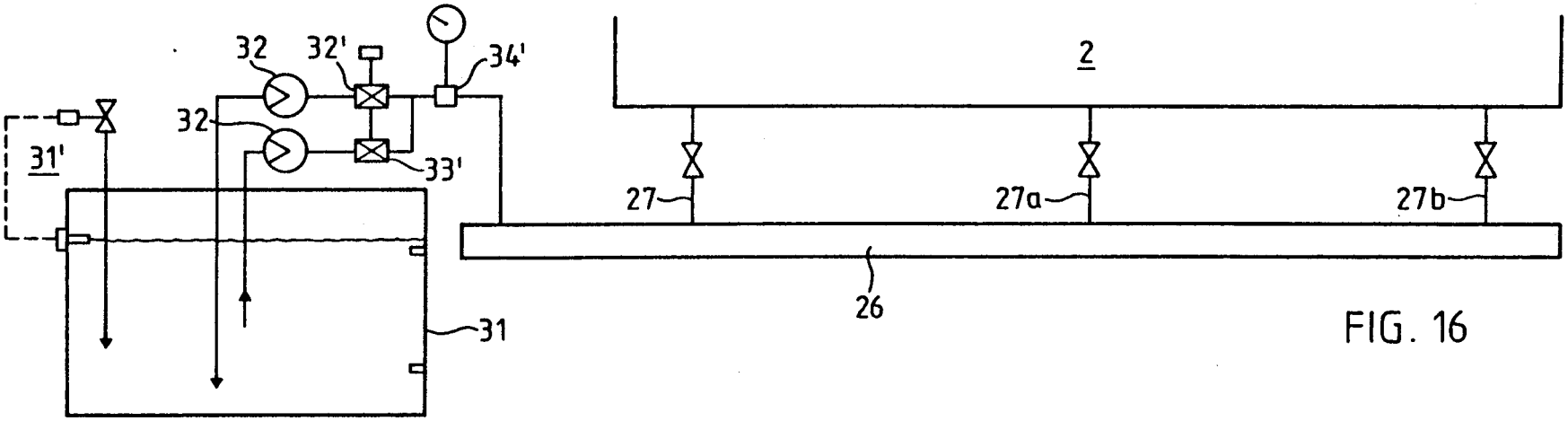
FIG. 16 is a schematic representation of the water supply of the steaming vessel.

FIG. 16 shows that several risers 27, 27*a*, 27*b* lead from the water duct 26 to the steaming vessel 2*a*. Pumps 32 supply the water duct 26 with water from a compensation tank 31, with a flowmeter 34' indicating the water quantity supplied. Throttle valves 32', 33' control the flow rate of the water and a level monitor 31' controls the water level in the tank 31.

Figure 17:
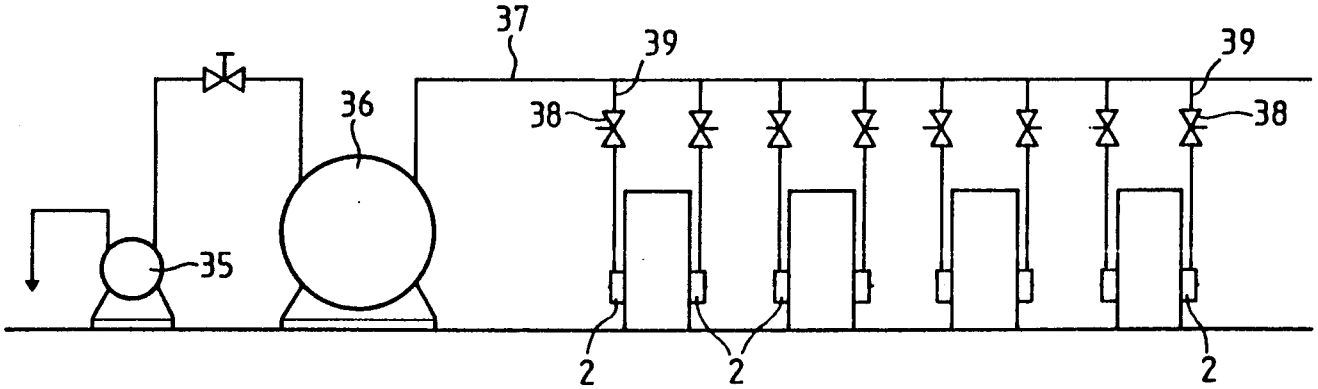
FIG. 17 is a schematic representation of the vacuum system of this equipment.

The vacuum system of a complete unit is illustrated in FIG. 17. A vacuum pump 35 continuously evacuates a vacuum vessel 36 to which is connected a vacuum line 37 from which, via valves 38, lines 39 lead to the separate steamers 2. The underpressure in each steamer 2 can thus be regulated by the respective valve 38.

FIG. 18 illustrates the temporal course of the spinning and steaming method:

As a first step, the finished cops 15 are removed from the steamer 2 and are placed on the conveyor 16 in a temporary position. Position A.

The fully spun cops 15 are moved from the spinning machine 1 into the steamer 2. Position B.

The steamer 2 is closed. Position B'.

The empty bobbins are brought to the spinning stations 14 by the conveyor 16. Position C'.

The spinning process is started. Position C.

The conveyor belt 16 continuously or in a step-by-step fashion removes the steamed cops 15 and, at the same time, fetches new bobbins. Position D.

The steamer 2 is evacuated and heated up. Position E.

The perforated sheet-metal strip 34 (see FIG. 11) is slid open. Position F.

The cops 15 are steamed. Position G.

The steamer 2 is de-aerated. Position H.

The steamer 2 is drained. Position I.

The cops 15 are dried. Position J.

The steamer 2 is opened. Position K.

Again, the cops 15 are removed from the steamer 2. Position A.

The above course repeats itself.

FIG. 19 is a diagram showing in the upper part the temperature in the steamer as a function of time and, iin the lower part, pressure in the steamer as a function of time. The method is subdivided into a treatment time $t_B$ and a drying time $t_T$. The diagram clearly shows that, during the heating-up periods, underpressure is always reduced. After the second heating-up period, temperature and, correspondingly, pressure, is kept constant for a longer period of time. For drying, the steamer 2 is repeatedly aerated, heated up, put under vacuum and aerated again. In the diagram:

| | |
|---|---|
| a = initial vacuum | i = aerating |
| b = heating-up | k = drying |
| c = steaming I | l = vacuum |
| d = intermediate vacuum | m = aerating |
| e = heating up | n = drying |
| f = steaming II | o = vacuum |
| g = aerating | p = aerating |
| h = terminal vacuum | q = cooling |
| $t_B$ = treatment time | $t_T$ = drying time |

The characteristic temporal material flow during steaming of cops is represented in FIG. 20, with the actions being plotted along the ordinate and the time intervals along the abscissa t in hours h. In this diagram:

| | |
|---|---|
| A = conveying | "1" = start |
| B = dwelling | "2" = steaming concluded |
| C = steaming | "3" = first charge ready |
| D = spinning | "4" = start winding process |

The non-marked intervals seen between the spinning periods D represent the action times of the cop-removal device.

With a temporary deposition of the cops—after conclusion of the steaming process and after readying of the first charge—the cop-removal device is activated, i.e., is ready for transferring the deposited cops.

The basic parameters of the process, the selection of steam pressure, the temperatures and the admixture of possible chemicals are known, especially for the steaming of yarns. Compare Freddy Wanger, Chemiefasern-/Textilindustrie Vol. 30/82, 1980, pp. 888–890; Melliand Textilberichte 66, 1985, pp. 525–526; Textilbetrieb, Vogel-Verlag Wuerzburg, 1981, Heft 7/8. The object of the invention can be adapted to fit all process and operational conditions.

Obviously, the term "heat treatment" as used in the patent claim also refers to sterilization processes such as applied during the manufacture of, e.g., hygiene articles, bandages, compresses and the like.

According to FIG. 21, a compressed-air line 68 is secured to the cop-removal rail 47. To this rail are attached a number of gripping members 48 which, as described earlier, serve to grip the cops 15. These cops 15 comprise a bobbin 15*a*, onto which, on the spinning machine 1, a thread is spun to form a cop 15. The gripping device 48 is provided with a nozzle 69 to which, with the aid of a clip 66, there is attached a small, inflatable rubber balloon 67. In the absence of compressed air in the compressed-air line 68, this balloon 67 has the shape indicated by the dash-dotted lines. As soon as compressed air is fed to the line 68, this balloon is inflated, until it comes to rest against the inside wall of the bobbin 15*a*, tightly holding the latter, as indicated by the solid lines.

Alternatively, the cops could be gripped peripherally, as with a collet.

In order to reduce the size of the steamer, it would be possible to push the cops closer together during heat treatment and/or humidification. Per se known means or handling devices for such a purpose are available. By the use of telescoping or elastically deformable rails 47, the embodiment of FIG. 21 can be made to meet these demands.

I claim:

1. An apparatus for spinning and treatment of yarns, comprising a spinning machine comprising a plurality of spinning stations arranged in a row for the production of spun cops, each of said stations having a cop; a conveyor for the removal of the spun cops from said spinning station; a handling device for delivering empty cops to the spinning machine and for transfer of the spun cops from the spinning machine to the conveyor; a steamer for treatment of the fully spun cops by at least one treatment step chosen from the group consisting of heat and humidification, said steamer comprising a plurality of steaming stations mounted parallel to the spinning machine whereby each spinning station is associated with an adjacent steaming station; said handling device comprising a gripping member associated with each spinning station adapted for removal of the spun cop from the spinning station and for inserting said spun cops into the associated steaming station.

2. The apparatus according to claim 1, wherein the steamer is located between the spinning station and an automatic handling device for the cops.

3. The apparatus according to claim 1 further comprising a winding machine comprising a plurality of spinning stations for the production of spun bobbins from said spun cops located along a side of said conveyor, said steamer being located on an opposite side of said conveyor.

4. The apparatus according to claim 1 further comprising a winding machine located adjacent said conveyor, said steamer being located between said spinning machine and said conveyor and in front of said spinning machine.

5. The apparatus according to claim 1, wherein said steamer includes a water bath space covered by a first perforated sheet metal strip, a second sheet metal strip being slidingly arranged on said first sheet metal strip for closing off said water bath space.

6. The apparatus according to claim 1 wherein said steamer includes a water bath space, further comprising a water duct, risers connected between said water duct and said water bath space, said risers having shutoff valves therein.

7. The apparatus according to claim 1, further comprising horizontal and vertical traveling conveyor means located above said steamer for the transport of said cops among the spinning stations, steamer and conveyor.

8. The apparatus according to claim 1, wherein said steamer includes a lockable lid articulated by means of a hinge mounted to a lateral wall of the steamer facing the spinning stations.

9. The apparatus according to claim 8, further comprising a lifting cylinder operatively connected to said lid and said lateral wall through a cantilever arm.

10. The apparatus according to claim 1, wherein the steamer is comprised of a plurality of steaming chamber elements.

11. The apparatus according to claim 10, wherein said steamer is comprised of a head element, at least one intermediate element and a terminal element, said head element comprising connectors for vacuum and aeration lines, temperature sensors, pressure sensors, a feed water connector and a drive for a lid of the steamer, and wherein each intermediate element comprises a heating element, a lid and a connector for a water-level sensor, said terminal element comprising a heating element, a lid and a ventilation connector.

12. The apparatus according to claim 1 further comprising a steam generator located exterior to said steamer operatively connected to said steamer.

13. The apparatus according to claim 1, wherein said steamer is arranged in a parallel contacting relationship with the spinning machine.

* * * * *